US008449319B2

(12) United States Patent
Fujii et al.

(10) Patent No.: US 8,449,319 B2
(45) Date of Patent: May 28, 2013

(54) CONNECTOR

(75) Inventors: Masayasu Fujii, Yokkaichi (JP); Wataru Shamoto, Yokkaichi (JP); Yukihiro Fukatsu, Yokkaichi (JP)

(73) Assignee: Sumitomo Wiring Systems, Ltd. (JP)

( * ) Notice: Subject to any disclaimer, the term of this patent is extended or adjusted under 35 U.S.C. 154(b) by 0 days.

(21) Appl. No.: 13/328,283

(22) Filed: Dec. 16, 2011

(65) Prior Publication Data

US 2012/0190229 A1 Jul. 26, 2012

(30) Foreign Application Priority Data

Jan. 25, 2011 (JP) ..... 2011-013307

(51) Int. Cl.
*H01R 29/00* (2006.01)

(52) U.S. Cl.
USPC ..... 439/489

(58) Field of Classification Search
USPC ..... 439/188, 489
See application file for complete search history.

(56) References Cited

U.S. PATENT DOCUMENTS 5,672,073 A * 9/1997 Matsumura et al. ..... 439/489
5,910,028 A 6/1999 Tsuji
6,241,542 B1 6/2001 Nishide et al.
6,592,398 B2 * 7/2003 Kashiyama et al. ..... 439/489
6,749,455 B2 * 6/2004 Nishide et al. ..... 439/352
7,918,676 B2 * 4/2011 Tonosaki ..... 439/157
2008/0153343 A1 * 6/2008 Kobayashi et al. ..... 439/374

* cited by examiner

*Primary Examiner* — Neil Abrams
*Assistant Examiner* — Travis Chambers
(74) *Attorney, Agent, or Firm* — Gerald E. Hespos; Michael J. Porco; Matthew T. Hespos

(57) ABSTRACT

An opening (36) where two terminal fittings (50) are exposed is formed in a surface of a housing (20). A connection detecting member (70) is movable along the surface of the housing (20) between a retracted position and a detection position. The connection detecting member (70) has a shorting terminal mounting portion (85) into which a shorting terminal (60) is mounted. The shorting terminal (60) holds the terminal fittings (50) in a shorted state and releases the shorted state as the two housings (20, 100) are connected properly and the connection detecting member (70) reaches the detection position. The connection detecting member (70) is arranged at a height position overlapping a deformation space for a lock arm (40) between the housing (20) and the lock arm (40). The shorting terminal mounting portion (85) projects lateral to the lock arm (40) while extending along the surface of the housing (20).

16 Claims, 17 Drawing Sheets

CONNECTOR

BACKGROUND OF THE INVENTION

1. Field of the Invention

The invention relates to a connector.

2. Description of the Related Art

U.S. Pat. No. 6,241,542 discloses a conventional connector with a housing into which terminal fittings are insertable. A lock arm projects from the upper surface of the housing. A connection detecting member is arranged above the housing and is movable to a retracted position and a detection position along the upper surface of the lock arm. A shorting terminal is mounted in the connection detecting member. The housing is connectable to a mating housing and the lock arm is deformed down in a connecting process. However, the lock arm returns resiliently when the connecting process is completed and locks the mating housing so that the two housings are held in a connected state.

The connection detecting member is held in the housing with movement prevented before the two housings are connected properly. Movement of the connection detecting member to the detection position is permitted as the housings are connected properly so that a properly connected state of the two housings can be detected.

The shorting terminal shorts the two terminal fittings while the connection detecting member is at the retracted position and is displaced with the connection detecting member to release the two terminal fittings from the shorted state as the connection detecting member reaches the detection position. Thus, the mating housing need not include a releasing rib for releasing the shorted state. However, the connection detecting member is arranged above the lock arm and causes an undesirable enlarging of the connector in a height direction.

The invention was completed in view of the above situation and an object thereof is to avoid enlargement of a connector in which a shorting terminal is mounted in a connection detecting member.

SUMMARY OF THE INVENTION

The invention relates to a connector with a housing that is configured for connection with a mating housing. At least two terminal fittings are disposed in the housing. At least one opening is formed in a wall of the housing to expose the terminal fittings. A lock arm projects from the wall of the housing and holds the housing in a connected state with the mating housing. At least one connection detecting member is mounted in the housing and is held at a retracted position so that movement relative to the housing is prevented prior to connection of the housing and the mating housing. However, the connection detection member is released from a movement prevented state as the housing connects properly to the mating housing and can move to a detection position. The connector also has at least one shorting terminal that normally is held in contact with the terminal fittings via the opening to short the terminal fittings. The shorting terminal releases the shorted state as the two housings are connected properly and the connection detecting member reaches the detection position. The connection detecting member at least partly overlaps a deformation space for the lock arm between the housing and the lock arm.

An ability to move the connection detecting member to the detection position indicates that the two housings are connected properly. The disposition of the connection detecting member at least partly overlapping the deformation space for the lock arm between the housing and the lock arm avoids enlarging the connector.

The connection detecting member preferably has at least one shorting terminal mounting portion at which the shorting terminal is at least partly mounted. The shorting terminal mounting portion preferably projects lateral to the lock arm and extends substantially along the surface of the housing. Accordingly, the shorting terminal can act on all of the terminal fittings located adjacent the wall of the housing and a degree of freedom in setting a shorted position can be increased.

The opening in the wall of the housing preferably is closed at least partly by the shorting terminal mounting portion regardless of whether the connection detecting member is at the retracted position or at the detection position. Thus, external matter is not likely to enter the housing through the opening.

A wire connection portion is formed at a rear side of each of the terminal fittings and is to be connected to an end portion of a wire. The wire connection portions are arranged at positions substantially facing the opening and the shorting terminal normally is in contact with the wire connection portions. Therefore, a degree of freedom in the construction of the terminal fittings except the wire connection portion can be increased.

A bottomed escaping recess preferably is formed in a surface of the shorting terminal mounting portion substantially facing the surface of the housing. A displaceable part of the shorting terminal enters the escaping recess when the shorted state by the shorting terminal is released. The bottomed escaping recess prevents exposure of the shorting terminal to the outside to increase electrical reliability.

The shorting terminal preferably is formed with at least one mounting portion to be mounted into the shorting terminal mounting portion. The surface of the housing and the mounting portion are kept in a non-contact state while the connection detecting member is displaced. Thus, the surface of the housing will not be damaged by a sliding movement of the shorting terminal.

A guide is formed on the surface of the housing and the shorting terminal mounting portion is formed with a guidable portion. The guidable portion can slide along the guide for guiding a movement of the connection detecting member and for preventing separation of the connection detecting member from the surface of the housing. Thus, stable movement of the connection detecting member is ensured.

An operable portion is formed at or near a rear end of the lock arm and can be operated when separating the two housings. The connection detecting member has a cover that at least partly covers the operable portion at the detection position. Thus, an external force in a connecting direction is not likely to be applied inadvertently to the operable portion so that an inadvertent resilient deformation of the lock arm can be avoided.

Two shorting terminal mounting portions preferably project toward opposite lateral sides of the lock arm and the shorting terminal is mounted in each of the shorting terminal mounting portion. Thus, a good balance can be ensured during movements.

These and other objects, features and advantages of the invention will become more apparent upon reading of the following detailed description of preferred embodiments and accompanying drawings. It should be understood that even though embodiments are separately described, single features thereof may be combined to additional embodiments.

DETAILED DESCRIPTION OF THE PREFERRED EMBODIMENTS

A connector 10 in accordance with the invention includes a housing 20 that is connectable to a mating housing 100. Note that, in the following description, ends of the housings 20, 100 that are to be connected are referred to as front ends concerning forward and backward directions.

Figure 9:
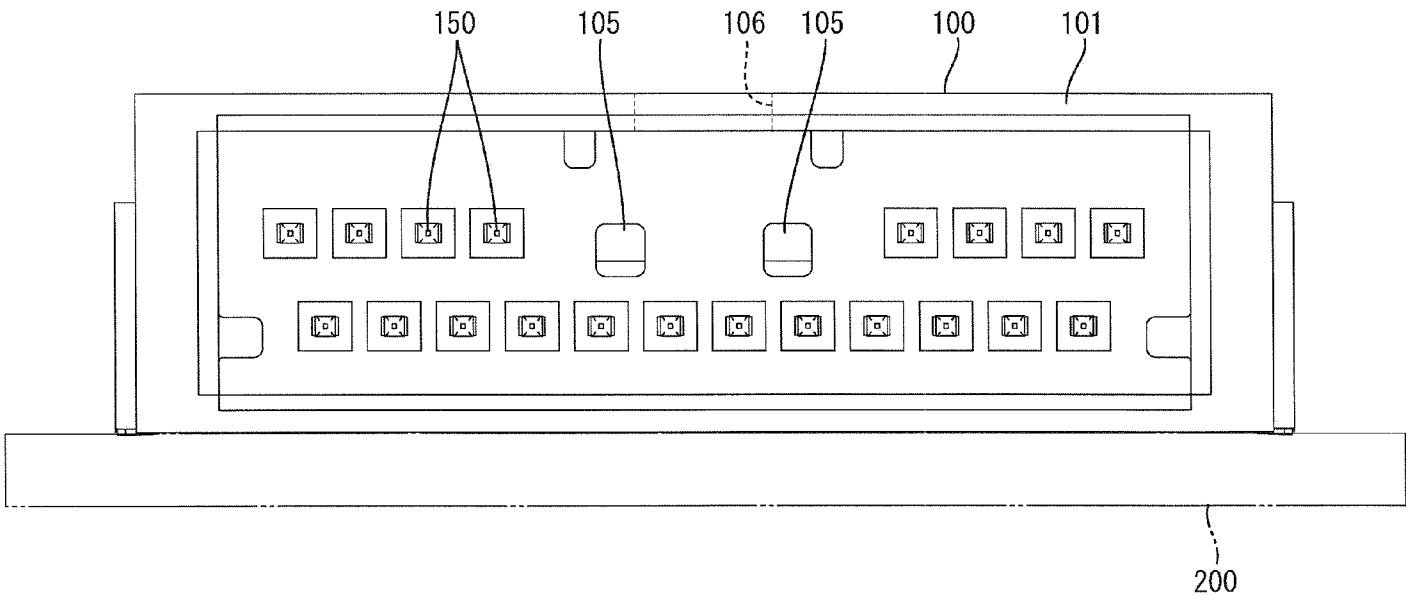
FIG. 9 is a front view of the mating housing.
Figure 10:
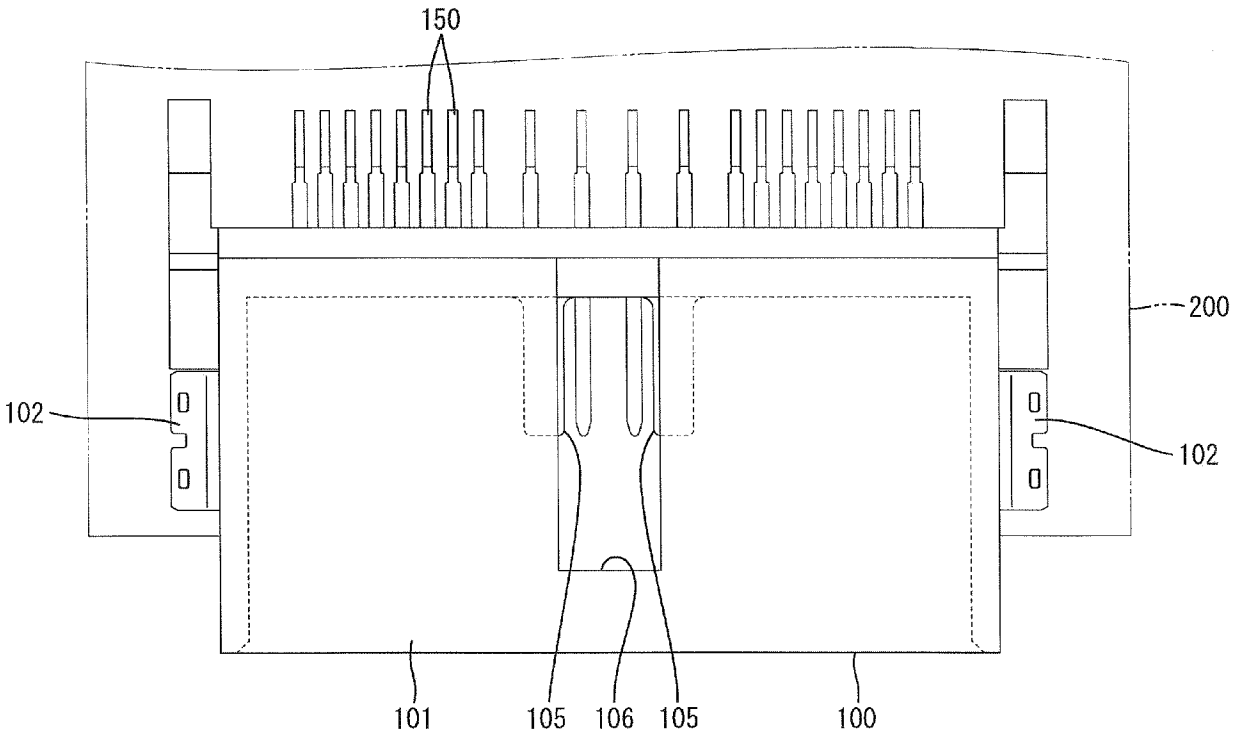
FIG. 10 is a plan view of the mating housing.
Figure 11:
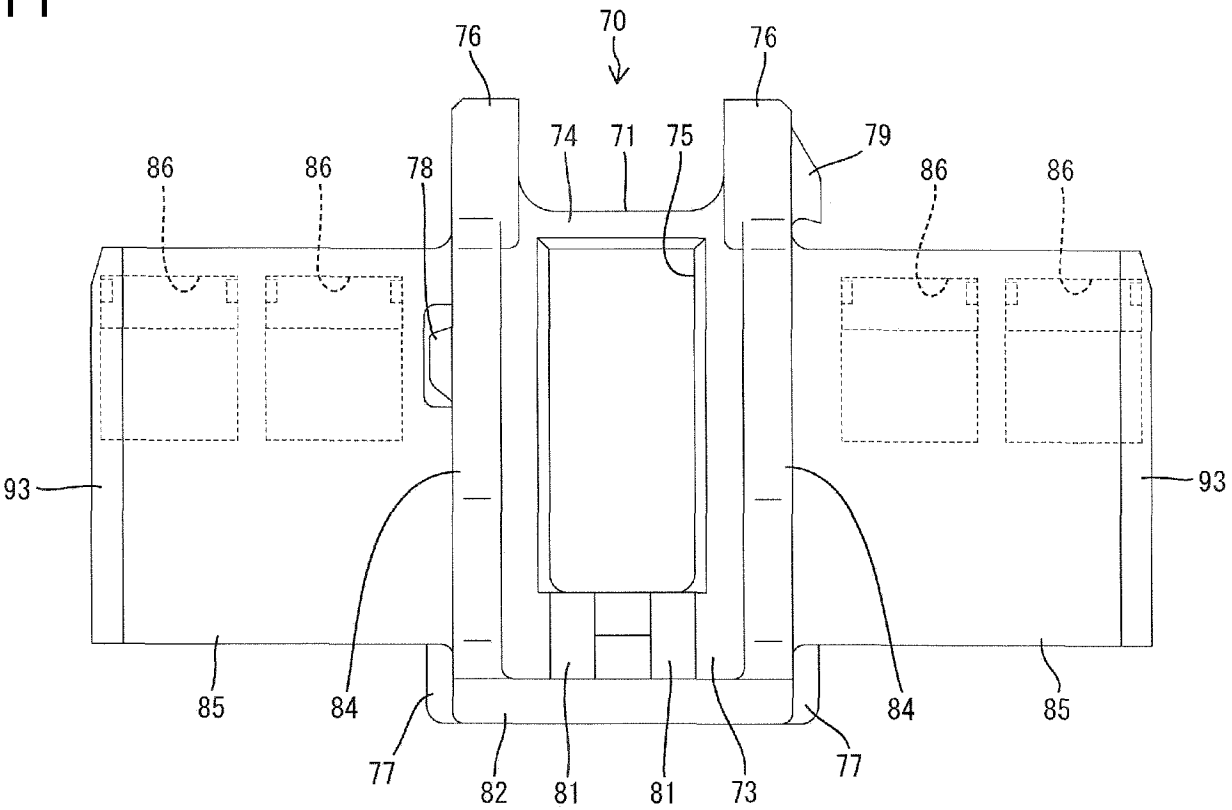
FIG. 11 is a plan view of the connection detecting member.
Figure 12:
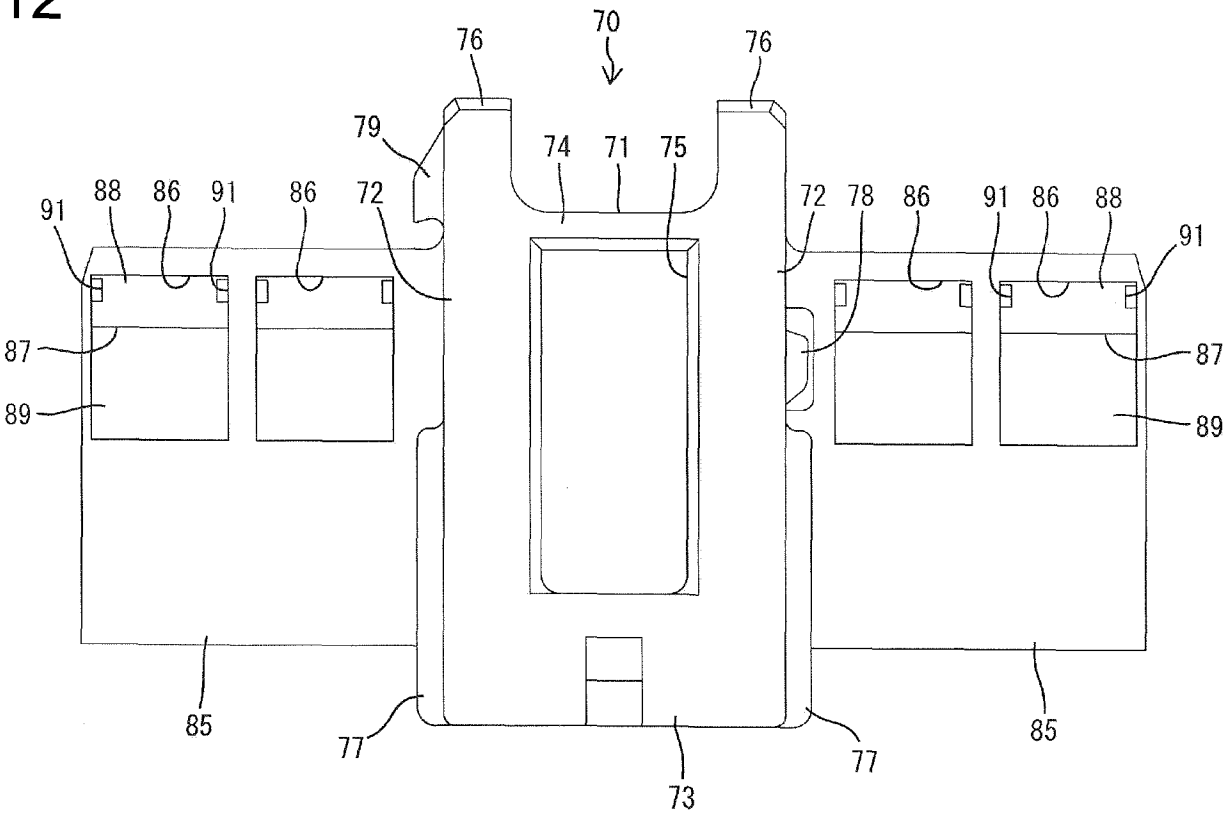
FIG. 12 is a bottom view of the connection detecting member.
Figure 13:
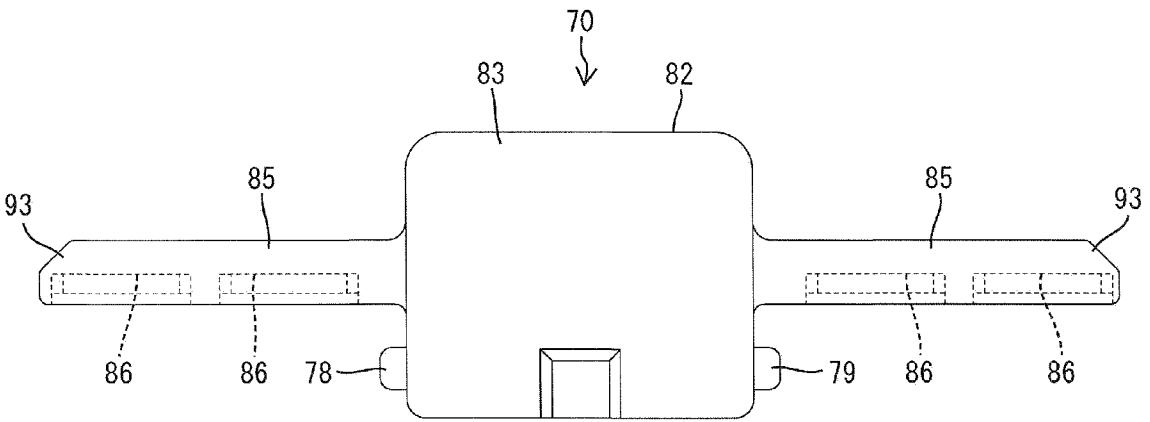
FIG. 13 is a rear view of the connection detecting member.
Figure 14:
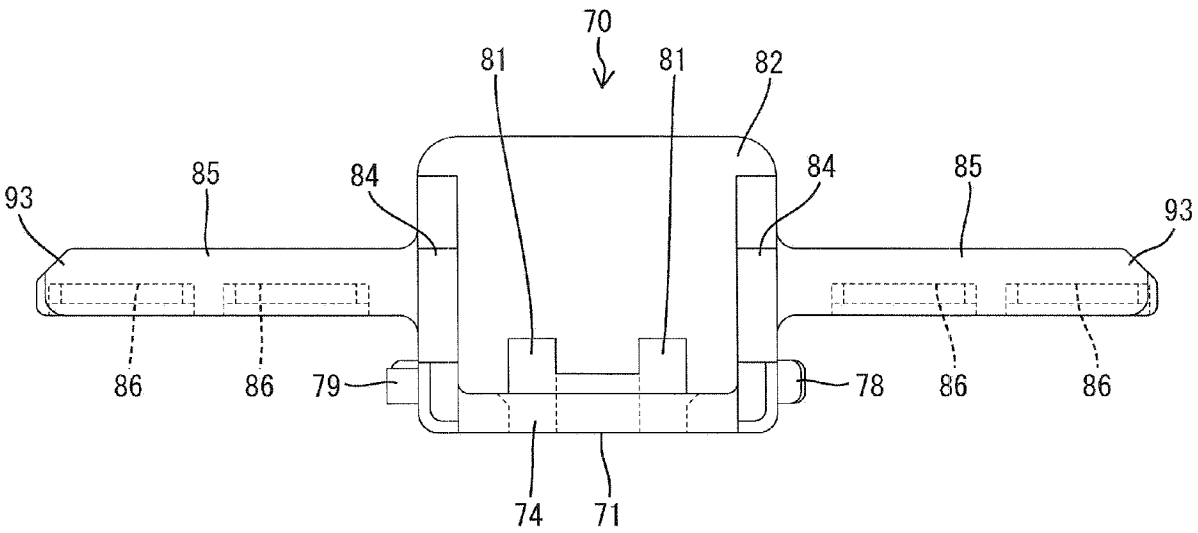
FIG. 14 is a front view of the connection detecting member.

The mating housing 100 is made e.g. of synthetic resin and, as shown in FIGS. 9 and 10, includes a wide rectangular tubular receptacle 101. Two pegs 102 made of metal are to be attached to the outer surfaces of the opposite side walls of the receptacle 101. Bottom ends of the pegs 102 are to be fixed (e.g. soldered or welded or glued) to a surface of a device, such as a printed circuit board 200 so that the mating housing 100 is fixed to the surface of the printed circuit board 200.

Male terminal fittings 150 are mounted while being arranged in upper and lower rows. Front end portions of the male terminal fittings 150 project into the receptacle 101 and are connectable to mating terminal fittings 50 when the two housings 20, 100 are connected properly. Further, rear end portions of the respective male terminal fittings 150 project back from the rear wall of the receptacle 101 and are connectable to conductive paths (not shown) of the printed circuit board 200.

Two releasing pieces 105 project forward in a widthwise intermediate part of the front surface of the rear wall of the receptacle 101. A lock hole 106 extends in forward and backward directions at a widthwise intermediate part of the upper wall of the receptacle 101 while leaving a front end portion of the upper wall. Note that the mating housing 100 has no releasing ribs for releasing a shorted state by shorting terminals.

Figure 1:
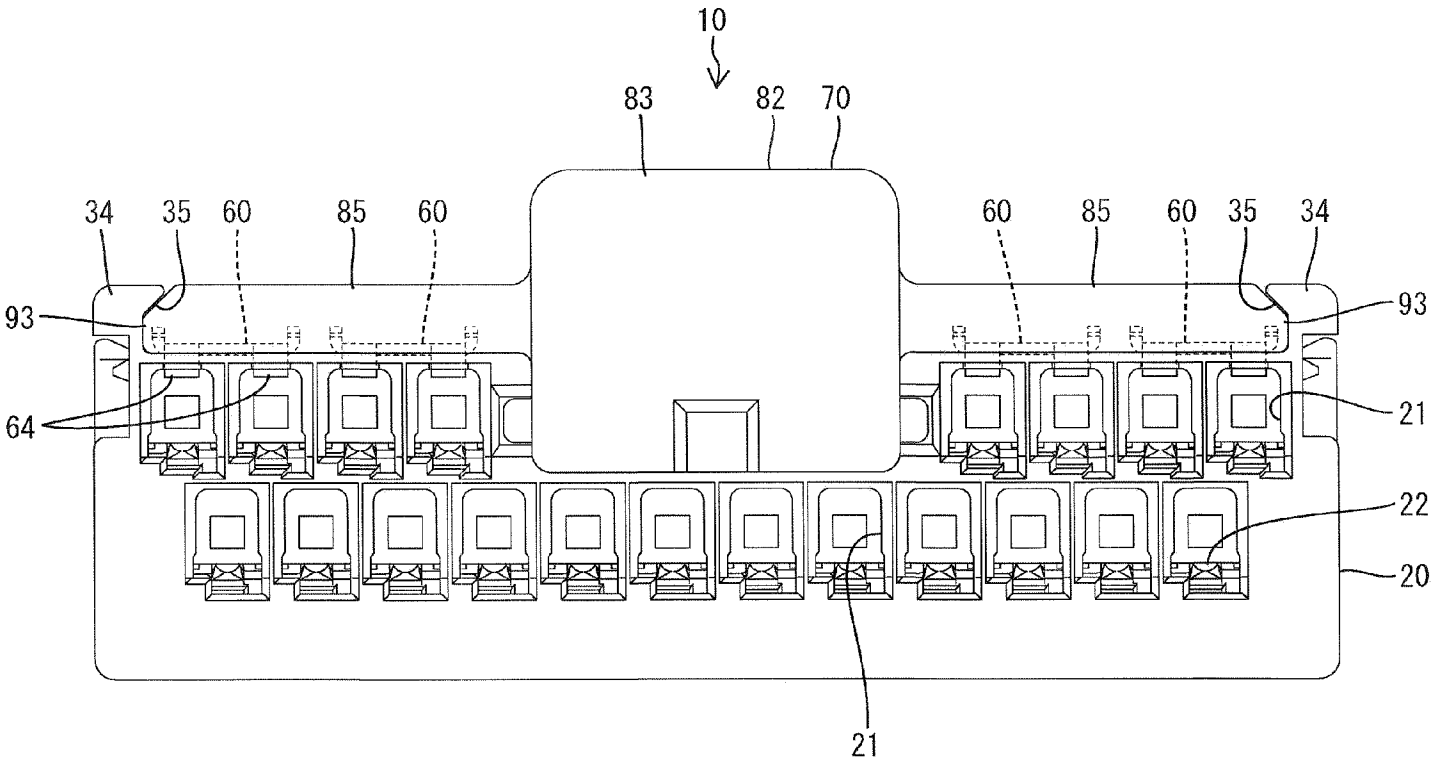
FIG. 1 is a rear view of a connector according to the invention.
Figure 2:
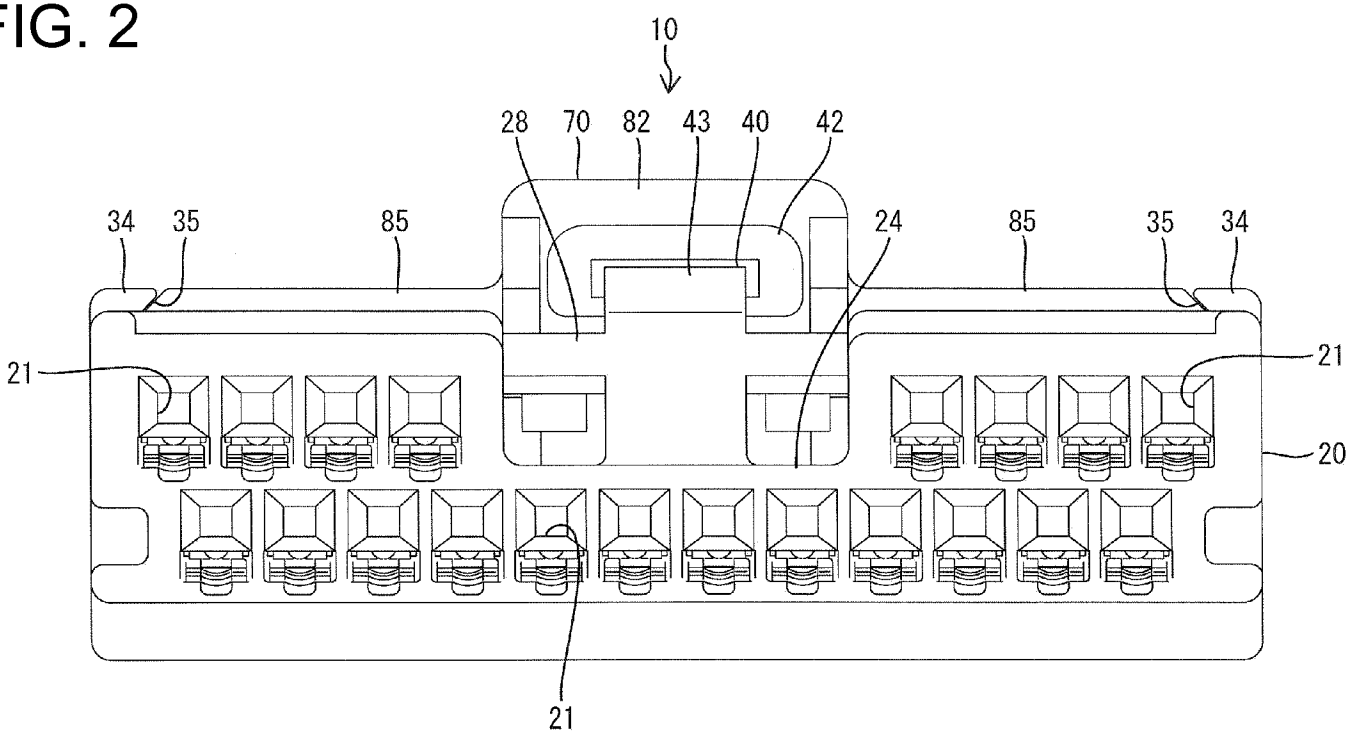
FIG. 2 is a front view of the connector.
Figure 5:
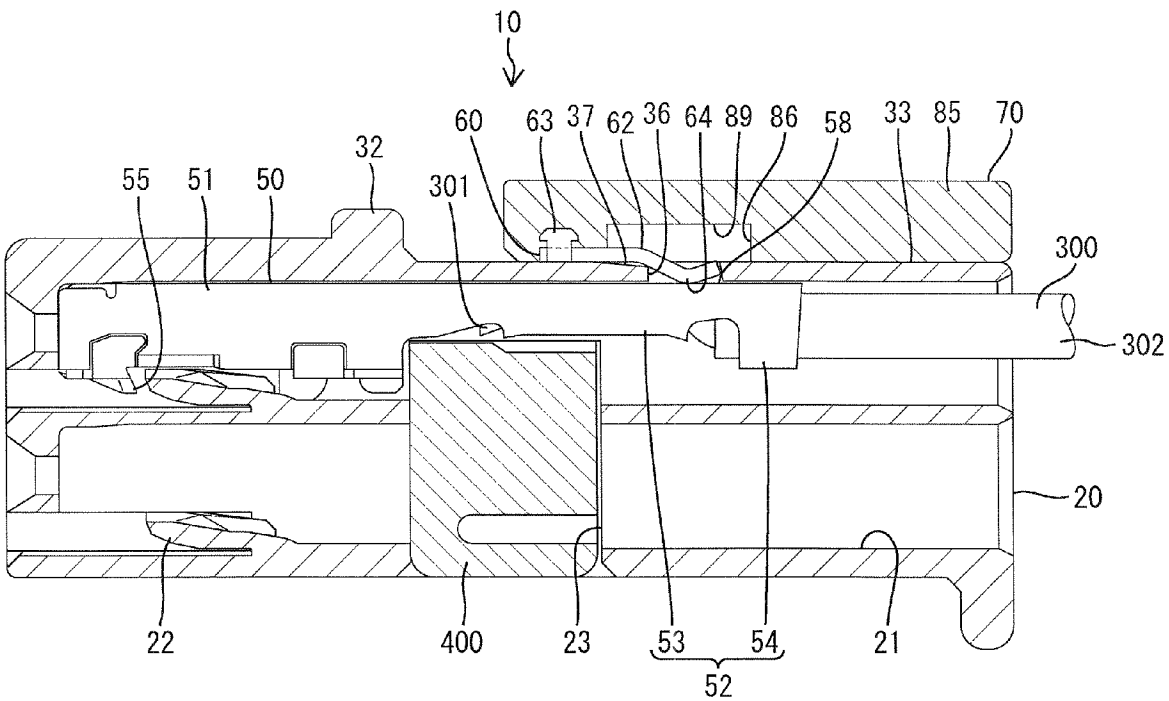
FIG. 5 is a sectional view of the connector with shorting terminals mounted therein.
Figure 18:
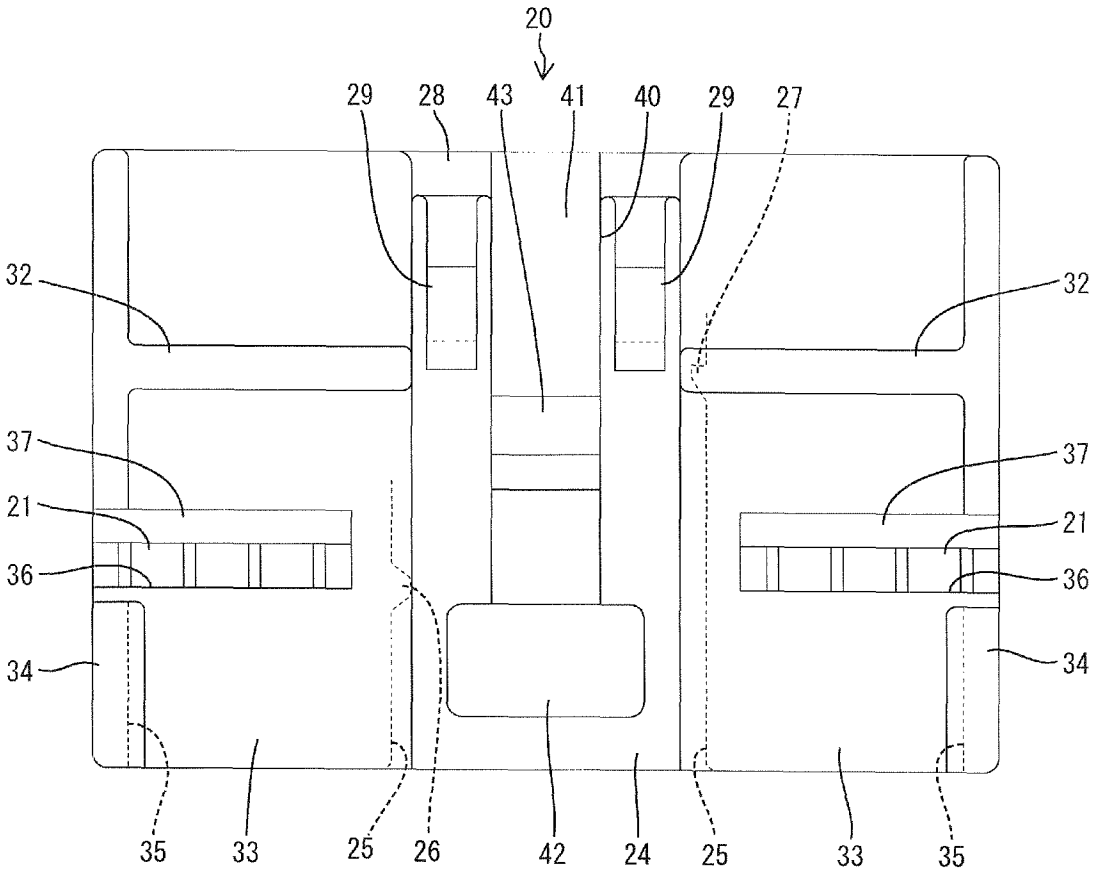
FIG. 18 is a plan view of a housing.

The housing 20 is made e.g. of synthetic resin and, as shown in FIGS. 2 and 18, defines a wide rectangular block that can fit into the receptacle 101. Cavities 21 are formed in the housing 20 at positions substantially corresponding to the respective male terminal fittings 150. The cavities 21 are arranged in upper and lower rows, in opposite widthwise end parts of the housing 20 and in one lower row in a widthwise central part of the housing 20. As shown in FIG. 5, a locking lance 22 projects substantially forward at lower surface of the inner wall of each cavity 21. Terminal fittings 50 are inserted into the cavities 21 from behind, and the properly inserted terminal fittings 50 are retained by the locking lances 22.

Each terminal fitting 50 is formed unitarily by bending, folding and/or embossing an electrically conductive metal plate and includes a rectangular tubular main portion 51 and a wire connection barrel 52 connected to and behind the main portion 51. The mating male terminal fitting 150 is inserted into the main portion 51 for connection when the two housings 20, 100 are connected properly. The main portion 51 is formed with an engaging portion 55 that projects down and is to be engaged with the locking lance 22. The barrel 52 comprises a wire barrel 53 to be crimped, folded or bent and connected to a core 301 at an end of a wire 300 and an insulation barrel 54 to be crimped, folded or bent and connected to an insulation coating 302 at the end of the wire 300. The terminal fitting 50 to be inserted into the cavity 21 in the upper row is arranged so that a base 58 between the wire barrel 53 and the insulation barrel 54 faces up or out.

A retainer mount hole 23 is formed in the lower surface of the housing 20. The retainer mount hole 23 has a depth to communicate with the respective cavities 21, and a retainer 400 is insertable therein. The terminal fittings 50 are retained doubly by the retainer 400 inserted into the retainer mount hole 23 after being retained by the locking lances 22.

A recess 24 is formed in a widthwise central part of the upper surface of the housing 20. The recess 24 is located between the cavities 21 at lateral sides in the upper row and extends in forward and backward directions and makes an opening at the rear end of the housing 20. Rib receiving grooves 25 are formed in opposite side walls of the recess 24 to extend in substantially forward and backward directions. One side wall of the recess 24 is formed with a first lock 26 that can lock a connection detecting member 70 at a retracted position RP (to be described later) and projects into the rib receiving groove 25. The other side wall is formed with a second lock 27 that can lock the connection detecting member 70 at a detection position DP (to be described later) and projects into the rib receiving groove 25. The second lock 27 is arranged before the first lock 26.

A substantially plate-like base wall 28 at least partly closes the front side of the recess 24 at the front end edge of the upper surface of the housing 20. The upper end of the base wall 28 is lower than the opposite widthwise sides of the upper surface of the housing 20. Two resilient locks 29 are cantilevered back into the recess 24 from opposite widthwise sides of the rear surface of the base wall 28. Holding projections 31 are formed on the lower surfaces of leading ends of the resilient locks 29 (see FIG. 7).

Two elongated projections 32 are formed at the opposite widthwise end edges of the upper surface of the housing 20. The elongated projections 32 extend in the width direction in a front part of the housing 20 and substantially faces the recess 24. A mounting surface 33 is defined as part of the upper surface of the housing 20 behind the elongated projections 32 and is more inward than a part before the elongated projections 32. The connection detecting member 70 is mounted to slide along the mounting surface 33. The connection detecting member 70 mounted on the mounting surface 33 of the housing 20 is stopped by the elongated projections 32 at the detection position DP so as not to slide any farther forward.

Two guides 34 project at the opposite widthwise sides of the mounting surface 33 of the housing 20. The guides 34 extend in forward and backward directions at a rear part of the housing 20. Substantially dovetailed or undercut guide grooves 35 are formed at inner sides of the guides 34 and open at the rear end of the housing 20. Further, two openings 36 are formed at substantially opposite widthwise sides of the mounting surface 33 of the housing 20. The openings 36 extend in the width direction at the rear part of the housing 20 and open at the opposite widthwise edges of the housing 20 and communicate with the respective cavities 21 in the upper row. The bottom portions 58 of the terminal fittings 50 inserted in the respective cavities 21 in the upper row are exposed to the outside through the openings 36 when the connection detecting member 70 is not mounted on the housing 20. Further, guiding surfaces 37 are formed on the mounting surface 33 of the housing 20 and gradually incline down toward the front end edges of the openings 36. Note that parts of the peripheral walls of the cavities 21 in the upper row corresponding to the mounting surface 33 particularly are thinner than parts thereof before the mounting surface 33.

A lock arm 40 is arranged in a widthwise central part of the upper surface of the housing 20. Specifically, the lock arm 40 includes an arm main body 41 that is cantilevered back from the upper end of the base wall 28. An operable portion 42 is raised at a free rear end of the arm main body 41 and a lock projection 43 projects in a lengthwise intermediate part of the upper surface of the arm main body 41. A front end portion of the arm main body 41 is arranged in the recess 24, and the lock projection 43 and the operable portion 42 are higher than the mounting surface 33 of the housing 20.

The lock projection 43 interferes with a front end portion of the receptacle 101 during a connecting operation of the two housings 20, 100. Thus, the arm main body 41 is deformed into the recess 24 with a connected part to the base wall 28 as a supporting point. The arm main body 41 resiliently returns when the two housings 20, 100 are connected properly and the lock projection 43 is fit into the lock hole 106 to hold the two housings 20, 100 in the connected state. On the other hand, the operable portion 42 can be pushed into the recess 24 to deform the arm main body 41 so that the lock projection 43 can be separated from the lock hole 106. As a result, the two housings 20, 100 can be pulled apart from each other. Accordingly, the interior of the recess 24 functions as a deformation space for the lock arm 40. Note that the resilient locks 29 described above are arranged at the opposite widthwise sides of the lock arm 40 and include parts overlapping a base end part of the lock arm 40 in a height direction.

The connection detecting member 70 is made e.g. of synthetic resin and is mounted into the housing 20 from behind for movement substantially along the mounting surface 33 of the housing 20 in forward and backward directions between the retracted position RP and the detection position DP. The connection detecting member 70 in the recess 24 at least partly overlaps the deformation space for the lock arm 40 in the height direction.

As shown in FIGS. 11 to 14, the connection detecting member 70 includes a detecting main body 71 that can enter the recess 24. The detecting main body 71 includes two side frame portions 72 that extend in forward and backward directions, a rear frame portion 73 that connects the rear ends of the side frame portions 72, and a front frame portion 74 that connects the front ends of the side frame portions 72, and a substantially rectangular escaping hole 75 is formed at the inner sides of the frame portions 72, 73, 74. The arm main body 41 enters the escaping hole 75 when the lock arm 40 is deformed in the process of connecting the housings 20, 100. Two substantially rectangular column shaped stops 76 project forward from the front ends of the side frame portions 72. The stops 76 contact the holding projections 31 of the resilient locks 29 from behind to prevent movement of the connection detecting member 70 toward the detection position DP.

Rear halves of the side frame portions 72 are formed with projecting guide ribs 77 extending in forward and backward directions along the outer side edges of the side frame portions 72. The guide ribs 77 can slide in engagement with the rib receiving grooves 25 of the housing 20. One side frame portion 72 is formed with a first engaging portion 78 that projects laterally out at a position before the guide rib 77, and the stop 76 connected to the other side frame portion 72 is formed with a second engaging portion 79 that projects laterally out at a position before the guide rib 77.

Two deformation restricting portions 81 project from the upper surface of the rear frame portion 73. The deformation restricting portions 81 are substantially side by side in the width direction and extend from the escaping hole 75 to a cover 82. The deformation restricting portions 81 slip under the operable portion 42 of the lock arm 40 when the connection detecting member 70 reaches the detection position DP to restrict deformation of the lock arm 40. The cover 82 is formed at the rear end of the detecting main body 71 and defines a rectangular plate that covers the operable portion 42 of the lock arm 40 from behind. The rear surface of the cover 82 defines an operation surface 83 extending substantially along the height direction, and the connection detecting member 70 is displaced to the detection position DP by pushing the operation surface 83 forward. Two side plates 84 are formed on the upper surfaces of the side frame portions 72 and are arranged from the front ends where the stops 76 are located to the front surface of the cover 82 while being elevated in the height direction.

Two shorting terminal mounting portions 85 project laterally out in intermediate parts of the outer surfaces of the side plates 84 in the height direction. That is, the shorting terminal mounting portions 85 project laterally out at the opposite widthwise sides of the lock arm 40. Specifically, the shorting terminal mounting portions 85 are substantially rectangular plates that substantially entirely cover the mounting surface 33 of the housing 20. Four bottomed mounting recesses 86 are formed in the lower surfaces of the shorting terminal mounting portions 85 and are arranged substantially side by side in the width direction for receiving shorting terminals 60.

A step 87 is formed near the front of each mounting recess 86. A shallow main recess 88 is formed before the step 87 and an escaping recess 89 that is deeper than the main recess 88 is formed behind the step 87. Two press-fit holes 91 are formed at opposite widthwise sides of the main recess 88 and are deeper than the main recess 88.

Figure 15:
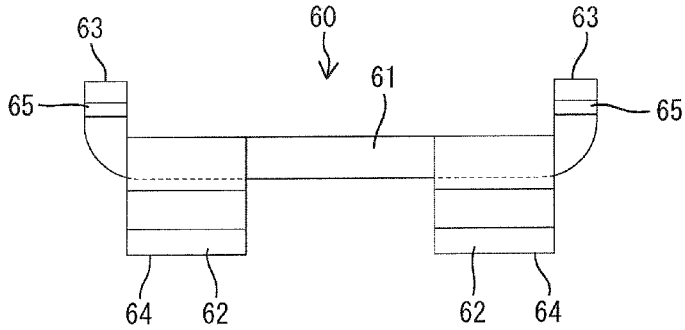
FIG. 15 is a rear view of the shorting terminal.
Figure 16:
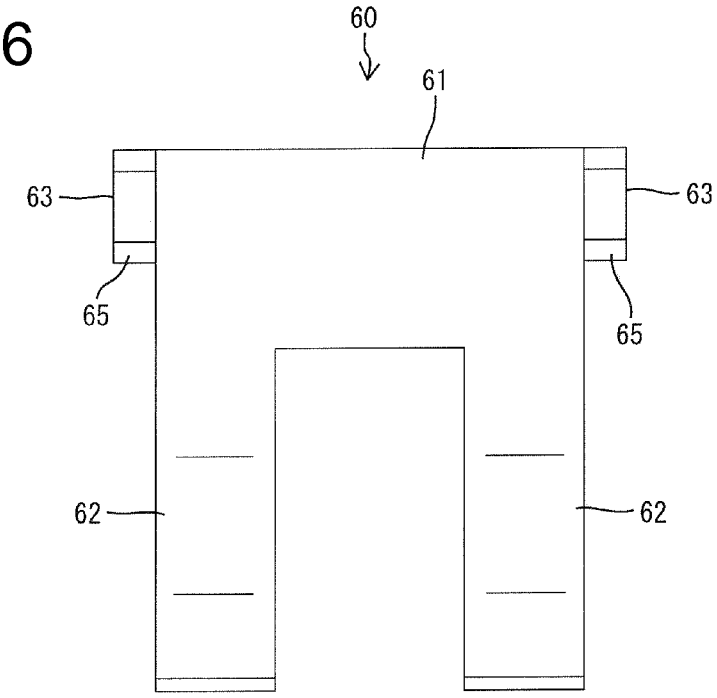
FIG. 16 is a plan view of the shorting terminal.
Figure 17:
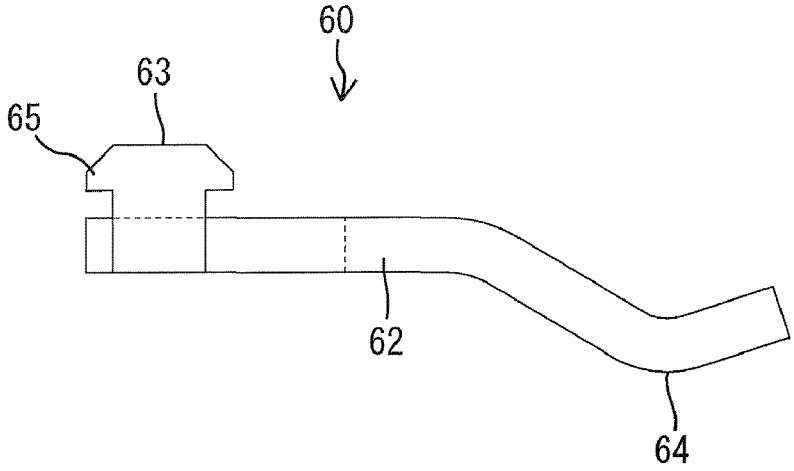
FIG. 17 is a side view of the shorting terminal.

Each shorting terminal 60 is formed unitarily bending, folding and/or embossing an electrically conductive metal plate and, as shown in FIGS. 15 to 17. Each shorting terminal 60 includes a coupling 61, two touching pieces 62 projecting back from opposite widthwise ends of the rear edge of the coupling 61 and two mounting portions 63 standing up from opposite widthwise end edges of the coupling 61. Leading end portions of the touching pieces 62 are bent down to form contacts 64 that can touch two corresponding terminal fittings 50. Two locking claws 65 project forward and backward at an upper end part of the mounting portion 63. When the shorting terminal 60 is mounted into the mounting recess 86, the coupling 61 is fit into the main recess 88, the locking claws 65 are press-fit into the respective press-fit holes 91 and the touching pieces 62 are arranged in the escaping recess 89. Further, with the shorting terminal 60 mounted in the mounting recess 86, the shorting terminal 60 excluding the contacts 64 are accommodated in the mounting recess 86.

Two guidable portions 93 extend in forward and backward directions at the outer widthwise end edges of the shorting terminal mounting portions 85. Upper end corners of the guidable portions 93 are cut off obliquely. The guidable portions 93 are inserted into the respective guide grooves 35 of the guides 34 from behind when the connection detecting member 70 is mounted into the housing 20 to prevent separation of the connection detecting member 70 from the mounting surface 33 of the housing 20.

The shorting terminals 60 are mounted to the respective shorting terminal mounting portions 85 of the connection detecting member 70. In this case, four shorting terminals 60 are press-fit into the corresponding mounting recesses 86.

The connection detecting member 70 then is mounted into the housing 20 from behind. The detecting main body 71 then is inserted into the recess 24 and the shorting terminal mounting portions 85 are arranged to cover the mounting surface 33 of the housing 20. In this way, the openings 36 are covered by the shorting terminal mounting portions 85 and the bases 58 of the respective terminal fittings 50 exposed at the openings 36 also are covered. The openings 36 remain covered by the shorting terminal mounting portions 85 regardless of whether the connection detecting member 70 is at the retracted position RP or at the detection position DP.

Figure 3:
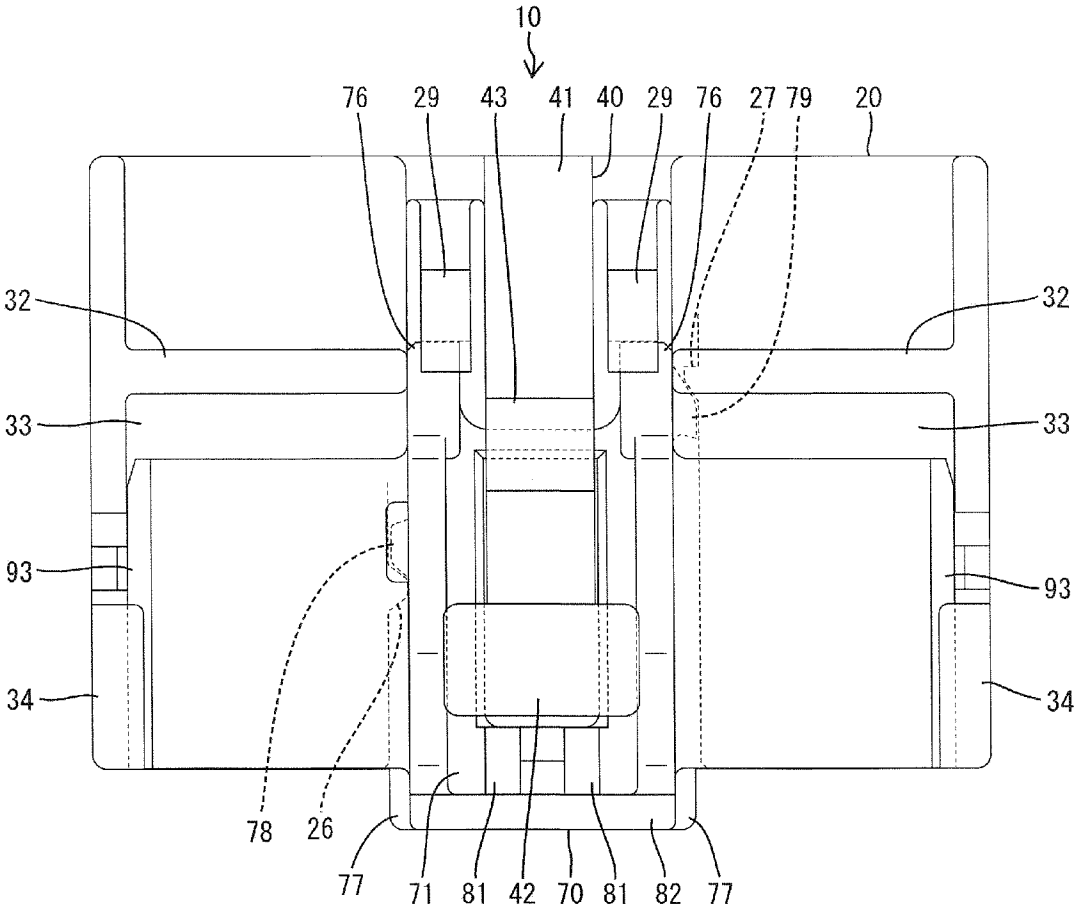
FIG. 3 is a plan view of the connector.
Figure 4:
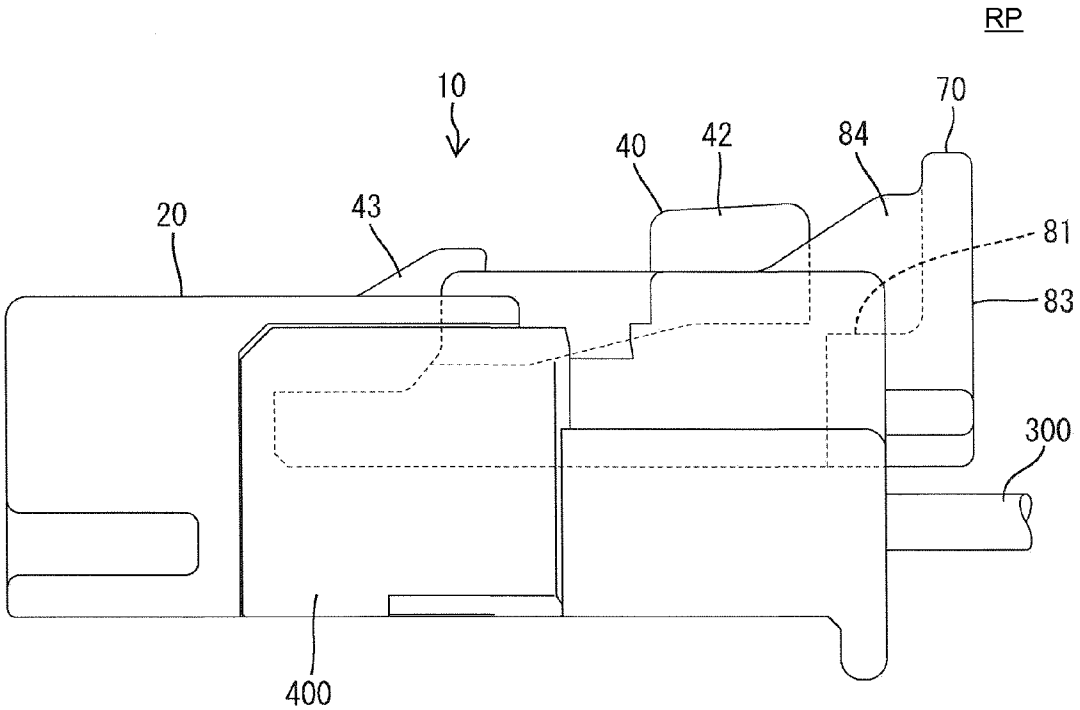
FIG. 4 is a side view of the connector.
Figure 6:
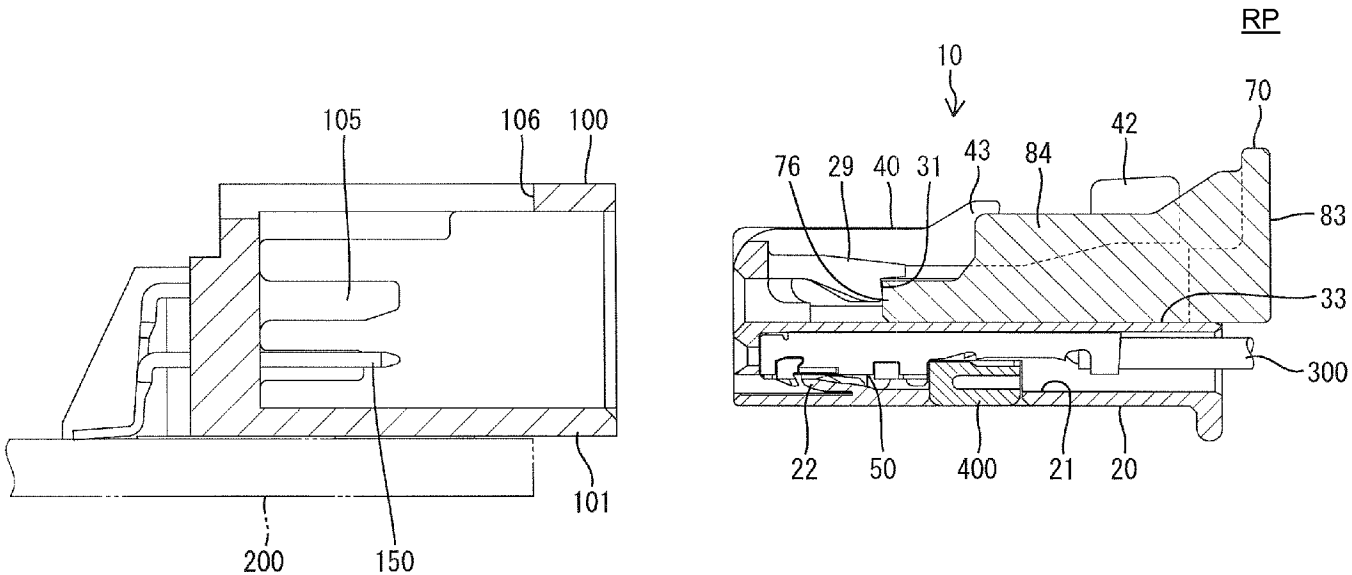
FIG. 6 is a sectional view of the connector before connection to a mating housing.

The stops 76 contact the holding projections 31 of the resilient locks 29 from behind when the connection detecting member 70 reaches the retraced position RP to prevent the connection detecting member 70 from being displaced any further forward. Additionally, the first engaging portion 78 contacts the first lock 26 from the front, as shown in FIGS. 3 and 6, to prevent the connection detecting member 70 from coming out backward. In this case, a rear end portion of the connection detecting member 70 projects back from the rear end surface of the housing 20.

When the connection detecting member 70 reaches the retracted position RP, the shorting terminals 60 mounted in the shorting terminal mounting portions 85 are arranged to straddle between the terminal fittings 50 adjacent in the width direction and, as shown in FIG. 5, the contacts 64 of the touching pieces 62 enter the respective cavities 21 through the openings 36. In this way, the contacts 64 of the touching pieces 62 contact the bottom portions 58 of the adjacent terminal fittings 50. As a result, the contacts 64 are in electrical contact with the respective terminal fittings 50 and the terminal fittings 50 are held in a shorted state. Thus, all of the terminal fittings 50 inserted into the cavities 21 in the upper row are shorted since the shorting terminal mounting portions 85 cover all of the cavities 21 in the upper row.

Figure 7:
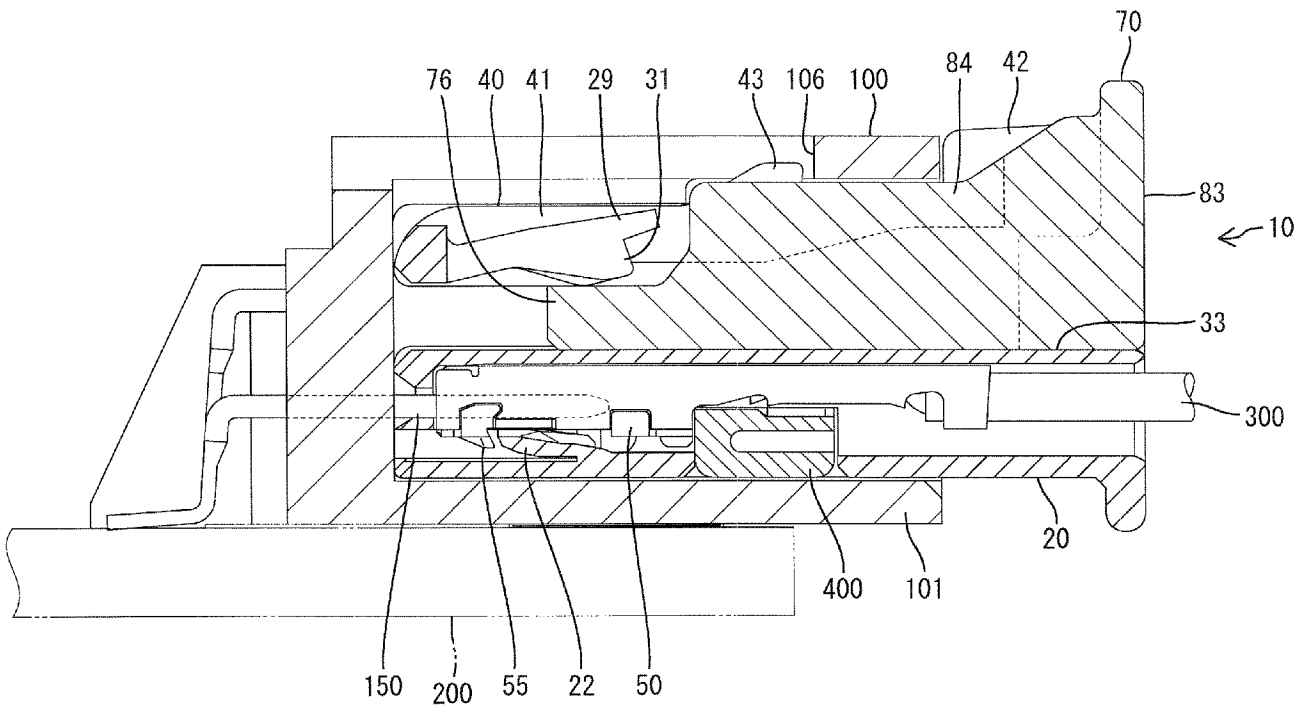
FIG. 7 is a sectional view of the connector in a state where the connector is properly connected to the housing and a movement of the connection detecting member to a detection position is permitted.

Subsequently, as shown in FIGS. 6 and 7, the mating housing 100 is placed opposite to the housing 20 and, in this state, the housing 20 is inserted into the receptacle 101 of the mating housing 100. The lock arm 40 is deformed and then returns resiliently so that the lock projection 43 is fit into the lock hole 106 to hold the two housings 20, 100 in the connected state. In this case, the lock arm 40 is deformed into the escaping hole 75 of the connection detecting member 70 to avoid interference with the connection detecting member 70. The terminal fittings 50 are connected electrically to the male terminal fittings 150 at a proper depth when the two housings 20, 100 are connected properly. Further, the releasing pieces 105 of the mating housing 100 contact the holding projections 31 of the resilient locks 29 from behind to deform the resilient locks 29 up when the two housings 20, 100 are connected properly. In this way, the holding projections 31 and the stops 76 are disengaged to permit the movement of the connection detecting member 70 forward to the detection position DP.

On the other hand, if the two housings 20, 100 are left insufficiently connected, the releasing pieces 105 do not reach positions where they contact the holding projections 31 of the resilient lock 29 and the holding projections 31 and the stops 76 are held engaged. Thus, the connection detecting member 70 cannot move to the detection position DP and the connection detecting member 70 is maintained at the retracted position RP. That is, the two housings 20, 100 can be judged to be connected properly if the connection detecting member 70 can move to the detection position DP, whereas the two housings 20, 100 can be judged to be in an insufficiently connected state if the connection detecting member 70 cannot move to the detection position DP is prevented.

Figure 8:
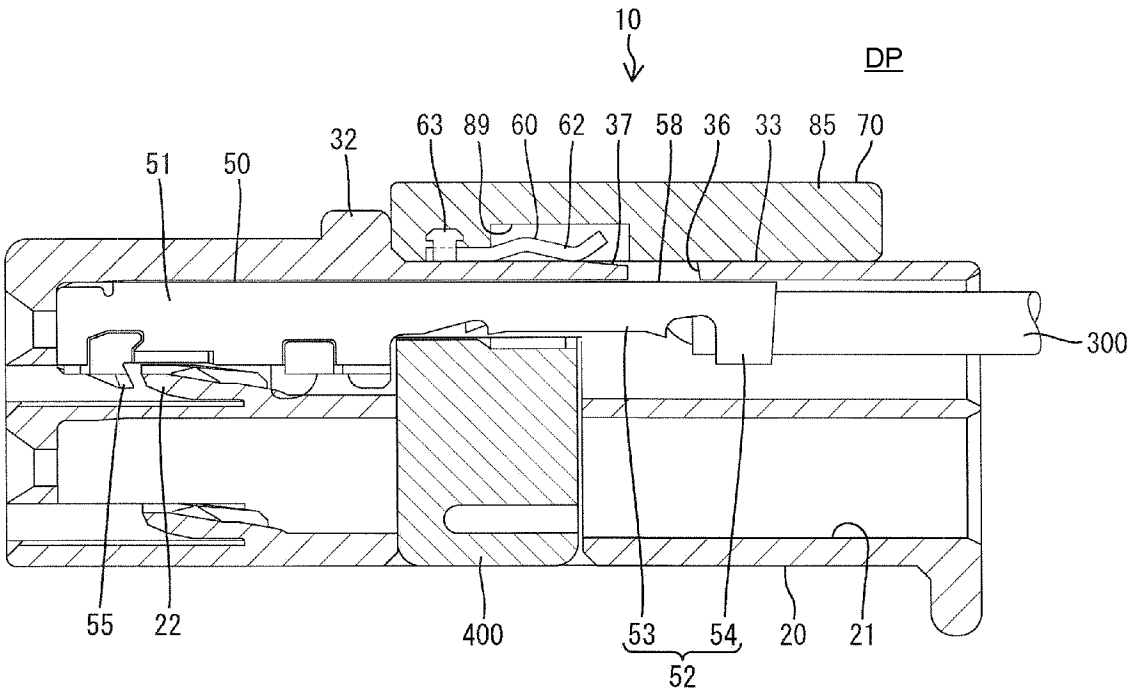
FIG. 8 is a sectional view of the connector in a state where the connection detecting member is at the detection position.

The operation surface 83 of the cover 82 is pushed from behind to displace the connection detecting member 70 to the detection position DP after the housings 20, 100 are connected properly. Thus, the lower surfaces of the shorting terminal mounting portions 85 slide on the mounting surface 33 of the housing 20 and the guidable portions 93 slide in the guide grooves 35 of the guide portions 34 so that the connection detecting member 70 is moved smoothly to the detection position DP. The shorting terminals 60 also move forward together with the connection detecting member 70 as the connection detecting member 70 moves toward the detection position DP. Then, as shown in FIG. 8, the touching pieces 62 of the shorting terminals 60 are retracted from the respective openings 36 and move onto the mounting surface 33 (upper surfaces of the peripheral walls of the cavities 21) of the housing 20 while being guided by the guiding surfaces 37 so that the shorted state of the pairs of corresponding terminal fittings 50 is released. At this time, the touching pieces 62 escape into the escaping recesses 89 of the shorting terminal mounting portions 85.

The front end edges of the shorting terminal mounting portions 85 contact the respective elongated projections 32 from behind when the connection detecting member 70 reaches the detection position DP to prevent the connection detecting member 70 from being displaced any farther forward. Additionally, the second engaging portion 79 contacts the second lock 27 from behind to prevent a returning movement of the connection detecting member 70 to the retracted position RP. Further, the deformation restricting portions 81 enter the deformation space for the lock arm 40 from behind when the connection detecting member 70 reaches the detection position DP, thereby preventing deformation of the lock arm 40. In this case, the cover 82 is in proximity to the rear end of the operable portion 42 and covers the operable portion 42 of the lock arm 40 and the recess 24 from behind. At the detection position DP, the operation surface 83 of the cover 82 is substantially continuous and flush with the rear end surface of the housing 20.

As described above, the connected state of the two housings 20, 100 can be known based on whether the connection detecting member 70 can be moved to the detection position DP. In this case, the connection detecting member 70 is arranged at the height position overlapping the deformation space for the lock arm 40 between the housing 20 and the lock arm 40. Thus, the connector 10 is not enlarged as compared with the case where the connection detecting member 70 is located above the lock arm 40. In addition, the shorting terminal mounting portions 85 project lateral to the lock arm 40 while substantially extending along the mounting surface 33 of the housing 20. Thus, the shorting terminals 60 can act on all the terminal fittings 50 in the one row (e.g. the upper row) located below the mounting surface 33 of the housing 20 and a degree of freedom in setting shorted positions can be increased.

The shorting terminals 60 move to shorted-state releasing positions as the connection detecting member 70 moves. Thus, it is not necessary to provide the mating housing 100 with a releasing rib for releasing the shorted state.

The bases 58 of the barrels 52 are arranged to be exposed at the openings 36 of the housing 20 and the shorting terminals 60 are in contact with the bases 58 of the barrels 52 when the connection detecting member 70 is at the retracted position RP. Thus, a degree of freedom in the structure of the terminal fittings 50 except the barrels 52 can be increased.

The openings 36 are covered by the shorting terminal mounting portions 85 regardless of whether the connection detecting member 70 is at the retracted position RP or the detection position DP. Thus, external matter cannot enter into the housing 20 through the openings 36.

The displaceable parts of the shorting terminals 60 enter the bottomed escaping recesses 89 formed in the shorting terminal mounting portions 85. Thus, exposure of the shorting terminals 60 to the outside can be avoided to increase electrical reliability.

The shorting terminals 60 are formed with the mounting portions 63 to be mounted and fixed to the shorting terminal mounting portions 85 and the mounting surface 33 of the housing 20 and the mounting portions 63 are kept in a non-contact state while the connection detecting member 70 moves. Thus, the mounting surface 33 of the housing 20 will not be damaged by sliding movements of the shorting terminals 60.

The movement of the connection detecting member 70 is guided and separation of the connection detecting member 70 from the housing 20 is prevented by sliding movements of the guidable portions 93 along the guide portions 34. Thus, stability in the movement of the connection detecting member 70 can be ensured.

The connection detecting member 70 is formed with the cover 82 that at least partly covers the operable portion 42 from behind at the detection position DP. Thus, application of an external force to the operable portion 42 from behind can be prevented and inadvertent resilient deformation of the lock arm 40 can be avoided.

The shorting terminal mounting portions 85 project to the opposite lateral sides of the lock arm 40 and the shorting terminals 60 are mounted in the respective shorting terminal mounting portions 85. Thus, a good balance is ensured during movements.

The invention is not limited to the above described and illustrated embodiment. For example, the following embodiments also are included in the scope of the invention.

Like a slider disclosed in Japanese Unexamined Patent Publication No. 2000-331745, the connection detecting member may automatically move to the detection position by being biased by a spring as the two housings are connected properly.

The connection detecting member may move in a direction crossing a connecting direction of the housings between the retracted position and the detection position.

The openings may be made at or near the rear end edge of the housing.

The housing, on which the connection detecting member is to be mounted, may be a male housing for housing male terminal fittings.

The shorting terminals may double as detection terminals which electrically detect that the two housings have reached a properly connected state.

What is claimed is:

1. A connector comprising:

a housing having a front end that is connectable to a mating housing and a rear end opposite the front end, the housing having at least two terminal fittings, at least one opening in a surface of the housing between the front and rear ends where the terminal fittings are exposed;

a lock arm projecting from the surface of the housing and holding the housing in a connected state with the mating housing;

at least one connection detecting member mounted into the housing and movable with respect to the housing between a retracted position projecting rearward on the housing and a detection position forward of the retracted position, the connection detecting member being held at the retracted position with a forward movement thereof relative to the housing prevented, and permitted to move forward to the detection position by being released from a movement prevented state relative to the housing as the housing is properly connected to the mating housing; and at least one shorting terminal mounted on the connection detection member and normally held in contact with the respective terminal fittings via the opening to short the terminal fittings and moves forward from the opening to release the shorted state of the terminal fittings as the two housings are connected properly and the connection detecting member reaches the detection position;

wherein the connection detecting member is arranged at a height position at least partly overlapping a deformation space for the lock arm between the housing and the lock arm.

2. The connector of claim 1, wherein:

the terminal fittings each are formed with a wire connection portion to be connected to an end portion of a wire;

the wire connection portions are arranged at positions substantially facing the opening; and the shorting terminal is normally in contact with the wire connection portions.

3. The connector of claim 1, wherein an escaping recess is formed in a surface of the shorting terminal mounting portion facing the surface of the housing for receiving a displaceable part of the shorting terminal when the shorted state by the shorting terminal is released.

4. The connector of claim 1, wherein:

the shorting terminal is formed with a mounting portion to be at least partly mounted into the shorting terminal mounting portion; and the surface of the housing and the mounting portion are kept in a non-contact state while the connection detecting member moves.

5. The connector of claim 1, wherein;

a guide portion is formed on the surface of the housing;

the shorting terminal mounting portion is formed with a guidable portion; and a movement of the connection detecting member is guided and separation of the connection detecting member from the surface of the housing is prevented by a sliding movement of the guidable portion along the guide portion.

6. The connector of claim 1, wherein:

an operable portion to be operated when separating the two housings is formed at a rear end portion of the lock arm; and the connection detecting member is formed with a cover for at least partly covering the operable portion at the detection position.

7. The connector of claim 1, wherein the connector is free of springs biasing the connection detection member rearward on the housing.

8. The connector of claim 1, wherein the connection detecting member is formed with at least one shorting terminal mounting portion in which the shorting terminal is mounted.

9. The connector of claim 8, wherein the shorting terminal mounting portion projects lateral to the lock arm while substantially extending along the surface of the housing.

10. A connector, comprising:

a housing that is connectable to a mating housing, the housing having at least two terminal fittings at least one opening in a surface of the housing where the terminal fittings are exposed;

a lock arm projecting from the surface of the housing and holding the housing in a connected state with the mating housing;

at least one connection detecting member mounted into the housing and being arranged at a height position at least partly overlapping a deformation space for the lock arm between the housing and the lock arm, the connection detecting member being movable with respect to the housing between a retracted position and a detection position, the connection detecting member being held at the retracted position with a movement thereof relative to the housing prevented, and being released from a movement prevented state relative to the housing and permitted to move to the detection position as the housing is properly connected to the mating housing, at least one shorting terminal mounting portion formed on the connection detection member to project lateral to the lock arm while substantially extending along the surface of the housing, the opening being covered by the shorting terminal mounting portion regardless of whether the connection detecting member is at the retracted position or at the detection position; and at least one shorting terminal mounted on the shorting terminal mounting portion and normally held in contact with the respective terminal fittings via the opening to short the terminal fittings and moves from the opening to release the shorted state of the terminal fittings as the two housings are connected properly and the connection detecting member reaches the detection position.

11. A connector, comprising:

a housing that is connectable to a mating housing, the housing having at least two terminal fittings, at least one opening in a surface of the housing where the terminal fittings are exposed;

a lock arm projecting from the surface of the housing and holding the housing in a connected state with the mating housing;

at least one connection detecting member mounted into the housing and movable with respect to the housing between a retracted position and a detection position, the connection detecting member being held at the retracted position with a movement thereof relative to the housing prevented, and permitted to move to the detection position by being released from a movement prevented state relative to the housing as the housing is properly connected to the mating housing;

two shorting terminal mounting portions project toward opposite lateral sides of the lock arm; and at least one shorting terminal is mounted in each of the shorting terminal mounting portions and is normally held in contact with the respective terminal fittings via the opening to short the terminal fittings and moves from the opening to release the shorted state of the terminal fittings as the two housings are connected properly and the connection detecting member reaches the detection position;

wherein the connection detecting member is arranged at a height position at least partly overlapping a deformation space for the lock arm between the housing and the lock arm.

12. The connector of claim 11, wherein:

the terminal fittings each are formed with a wire connection portion to be connected to an end portion of a wire;

the wire connection portions are arranged at positions substantially facing the opening; and the shorting terminal is normally in contact with the wire connection portions.

13. The connector of claim 11, wherein an escaping recess is formed in a surface of the shorting terminal mounting portion facing the surface of the housing for receiving a displaceable part of the shorting terminal when the shorted state by the shorting terminal is released.

14. The connector of claim 11, wherein:

the shorting terminal is formed with a mounting portion to be at least partly mounted into the shorting terminal mounting portion; and the surface of the housing and the mounting portion are kept in a non-contact state while the connection detecting member moves.

15. The connector of claim 11, wherein;

a guide portion is formed on the surface of the housing;

the shorting terminal mounting portion is formed with a guidable portion; and a movement of the connection detecting member is guided and separation of the connection detecting member from the surface of the housing is prevented by a sliding movement of the guidable portion along the guide portion.

16. The connector of claim 11, wherein:

an operable portion to be operated when separating the two housings is formed at a rear end portion of the lock arm; and the connection detecting member is formed with a cover for at least partly covering the operable portion at the detection position.

* * * * *